US008191941B2

(12) United States Patent
Ramsauer

(10) Patent No.: US 8,191,941 B2
(45) Date of Patent: Jun. 5, 2012

(54) LOCK WITH A TURNING AND DRAWING BOLT

(76) Inventor: Dieter Ramsauer, Schwelm (DE)

( * ) Notice: Subject to any disclaimer, the term of this patent is extended or adjusted under 35 U.S.C. 154(b) by 424 days.

(21) Appl. No.: 11/793,380

(22) PCT Filed: Dec. 14, 2005

(86) PCT No.: PCT/EP2005/013467

§ 371 (c)(1),
(2), (4) Date: Jun. 18, 2007

(87) PCT Pub. No.: WO2006/066782

PCT Pub. Date: Jun. 29, 2006

(65) Prior Publication Data

US 2008/0203736 A1 Aug. 28, 2008

(30) Foreign Application Priority Data

Dec. 17, 2004 (DE) ..... 20 2004 019 694 U
Feb. 23, 2005 (DE) ..... 20 2005 003 027 U

(51) Int. Cl.
*E05C 3/02* (2006.01)

(52) U.S. Cl. ..... 292/194; 292/219; 292/221; 292/57

(58) Field of Classification Search ..... 292/194, 292/219, 220, 221, 226, 227, 210, 57, 60, 292/63; 70/370, 369, 371, 140, 379 R, 379 A, 70/380; 411/553, 552
See application file for complete search history.

(56) References Cited

U.S. PATENT DOCUMENTS 2,580,026 A * 12/1951 Jacobi ..... 74/504
(Continued)

FOREIGN PATENT DOCUMENTS

DE 342387 10/1921
(Continued)

OTHER PUBLICATIONS

Catalog "Southco Compression Latches" pp. 62, 63 and 67 by the firm of Southco. Inc.

*Primary Examiner* — Carlos Lugo
*Assistant Examiner* — Mark Williams
(74) *Attorney, Agent, or Firm* — Frommer Lawrence & Haug LLP

(57) ABSTRACT

A pull-turn bolt latch for mounting in an opening in a thin wall, particularly for securing plug-ins, doors or flaps in switch cabinets, comprises a housing that can be secured in a non-round opening in a thin wall, a shaft which is provided with an external thread and which is mounted in the housing so as to be rotatable but fixed with respect to axial displacement, on which external thread a bolt provided with a matching threaded bore hole is guided in the housing so as to be acted upon by pressure by a spring engaging around the shaft such that when the shaft is rotated by hand or by a tool into the stop position at the outer end of the shaft or when the pressure is relaxed the bolt carries out a rotational movement with the shaft covering at least 90°, and in the position remote of the stop position accompanied by axial guidance, such as in an axial slot formed for the bolt in the housing carries out a translational movement in axial direction. The housing has a head part such as a flange which covers the outer edge of the opening in the mounted position, and a body part proceeds from this head part and penetrates the opening. The invention is characterized in that flexible holding elements project from the body part in direction of the outer surface thereof and form a self-locking contact surface or contact line or contact point for supporting the body part without play on the rim or edge of the opening.

23 Claims, 12 Drawing Sheets

U.S. PATENT DOCUMENTS

| | | | | | |
|---|---|---|---|---|---|
| 3,774,946 | A | * | 11/1973 | Hammann | 292/64 |
| 4,080,522 | A | * | 3/1978 | Schimmels | 200/295 |
| 4,380,161 | A | * | 4/1983 | Bassi | 70/168 |
| 5,076,080 | A | * | 12/1991 | Fuss et al. | 70/125 |
| 5,152,161 | A | * | 10/1992 | Lee | 70/127 |
| 5,165,738 | A | * | 11/1992 | McCormack | 292/67 |
| 5,251,467 | A | * | 10/1993 | Anderson | 70/370 |
| 5,435,159 | A | * | 7/1995 | Ramsauer | 70/370 |
| 5,669,731 | A | * | 9/1997 | Hironaka et al. | 403/397 |
| 6,161,404 | A | * | 12/2000 | Westwinkel | 70/370 |
| 6,237,970 | B1 | * | 5/2001 | Joannou | 292/241 |
| 6,295,850 | B1 | * | 10/2001 | Anderson | 70/492 |
| 6,568,226 | B1 | * | 5/2003 | Ramsauer | 70/127 |
| 6,640,592 | B2 | * | 11/2003 | Vickers | 70/83 |
| 6,676,176 | B1 | * | 1/2004 | Quandt | 292/202 |

FOREIGN PATENT DOCUMENTS

| | | | |
|---|---|---|---|
| DE | 1112152 | | 8/1951 |
| DE | 40 06 707 | | 9/1991 |
| DE | 94 11 368.8 | | 10/1994 |
| EP | 0 649 955 | | 4/1994 |
| FR | 862.487 | | 3/1941 |
| FR | 862487 | * | 3/1941 |
| FR | 2 828 227 | | 2/2003 |
| WO | 00/31365 | | 6/2000 |
| WO | 00/79081 | | 12/2000 |
| WO | 2004/035971 | | 4/2004 |

* cited by examiner

LOCK WITH A TURNING AND DRAWING BOLT

CROSS-REFERENCE TO RELATED APPLICATIONS

This application claims priority of International Application No. PCT/EP2005/013467, filed Dec. 14, 2005 and German Application No. 20 2004 019 694.8, filed Dec. 17, 2004 and German Application No. 20 2005 003 027.9, filed Feb. 23, 2005, the complete disclosures of which are hereby incorporated by reference.

BACKGROUND OF THE INVENTION a) Field of the Invention

The invention is directed to a pull-turn bolt latch for mounting in an opening in a thin wall, particularly for securing plug-ins, doors or flaps in switch cabinets, comprising a housing that can be secured in a non-round opening in a thin wall, a shaft which is provided with an external thread and which is mounted in the housing so as to be rotatable but fixed with respect to axial displacement, on which external thread a bolt provided with a matching threaded bore hole is guided in the housing so as to be acted upon by pressure by a spring engaging around the shaft such that when the shaft is rotated by hand or by a tool in the stop position at the outer end of the shaft or when the pressure is relaxed the bolt carries out a rotational movement of at least 90° with the shaft, and in the position remote of the stop position accompanied by axial guidance in an axial slot formed for the bolt in the housing or other guidance during the rotational movement of the shaft carries out a translational movement in axial direction, wherein the housing has a head part such as a flange which covers the outer edge of the opening and a body part proceeding from this head part and penetrating the opening.

b) Description of the Related Art

A pull-turn bolt latch of the type mentioned above is already known from pages 62, 63 and 67 of the catalog "Southco Compression Latches" by the firm of Southco. In the known latch, fastening to the sheet metal is carried out by means of a coupling nut from the front according to page 62 of the catalog, and by means of a nut from the rear according to page 63 of the catalog, and by means of two rivets or two screws according to page 67 of the catalog.

One of the drawbacks of the prior art is that mounting is very complicated. Also, the nuts or screws can loosen as a result of vibration and can fall into the circuit and substantially impair the reliability and operating safety of the circuits contained therein. Further, the tongue can be moved into the open position and into the closed position over the entire axial path of the tongue in the housing, i.e., user error is also possible.

In the prior art, handles must also be fastened by screws for pulling out the drawer or plug-in or for opening the door or flap, which increases the risk of loosened screws.

OBJECT AND SUMMARY OF THE INVENTION

It is the primary object of the invention to provide a latch of the type mentioned above which on the one hand prevents user error and ensures greater operating safety and in which no fastening parts can be lost and which on the other hand enables a substantially simpler mounting, for example, simply by means of snapping in spring-loaded holding elements.

The above-stated object of facilitating mounting is met substantially in that flexible holding elements project from the body part in direction of the outer surface of the body part and form a self-locking contact surface or contact line or contact point to support the body part without play on the rim or edge of the opening.

This feature enables fast mounting without requiring inconvenient use of screws which can also loosen and help to cause short circuits in the plug-in or drawer and thus impair the reliability of the plug-in.

According to an embodiment form, the holding elements are formed by leaf spring parts which are inserted into the body part.

According to another embodiment form, the holding elements are formed by push elements which are mounted in the body part so as to be displaceable in a defined manner against spring force.

According to yet another embodiment form, the holding elements are formed by lifting elements which are mounted in the body part so as to be swivelable in a defined manner against spring force around an axis extending parallel to the thin wall.

In this case, the body part can have a substantially prism-shaped, e.g., rectangular, cross section, and at least one holding element proceeds in each instance from opposite sides of the rectangle.

Depending on the required robustness, it can be advantageous to arrange a plurality of holding elements, such as two or four, symmetrically with respect to the shaft axis.

Two opposing holding elements can form a group in each instance, and a group is arranged, respectively, on both sides of the shaft.

The head part can form a handle. This does away with the need for providing a handle or finger grip, e.g., for pulling out a drawer.

According to yet another embodiment form, a drive for rotating the shaft can be mounted in the head part, preferably in the form of a turning knob and/or a receptacle for a wrench or for an insertion tool such as a phillips head screwdriver.

The free end of the body part can form at least one projection serving as a stop for the rotational movement of the turning bolt.

It may be advantageous when one stop is formed for the rotational movement of the turning bolt of the body part and the other stop is formed by a suitably arranged edge of an opening in a bend or a shoulder of the thin wall, which opening is preferably rectangular or L-shaped.

According to yet another embodiment form of the invention, the spring parts are secured by lateral edges of the opening after the housing is mounted in the opening. This provides an additional protection against falling out that results automatically after mounting.

The spring parts can be formed by the ends of an individual leaf spring that is bent in a U-shape.

The above-stated further object of preventing user error is met substantially in that an axially slit sleeve which is provided with a flange at one end engages around the spring, this flange having a mark such as a notch or hole and being held on the head part of the housing so as to be rotatable, and in that the flange of the sleeve supports the spring and the outer end of the shaft against spring force by a rim area facing the spring, and in that the slot in the sleeve is penetrated by the bolt whose rotational movement is transmitted to the sleeve and therefore to its flange.

These features enable the user to verify the position of the bolt when actuating it, which helps to prevent user error. On the other hand, preventing user error also increases operating safety.

Operation is facilitated according to a further development when the mark at the flange of the sleeve is aligned with this slot (and therefore with the bolt) because then it can be checked, e.g., when there are a plurality of latches to be operated simultaneously, whether or not all of the bolts are in the desired position (open or closed).

This applies particularly when the housing likewise has a mark which indicates, in conjunction with the mark at the flange of the sleeve, determined rotational positions of the bolt, particularly its end positions (bolt in the open and closed position) which is offset, e.g., by 90 degrees.

Checking is especially simple when the mark on the flange of the sleeve is a notch or a hole and the mark on the housing is a colored dot that is arranged in such a way that the notch or hole allows, e.g., a red colored dot to be seen in one position (e.g., the open position) of the bolt and, e.g., a green colored dot to be seen in the second position (e.g., the closed position that is offset by 90 degrees).

Operation is further facilitated when the flange of the sleeve forms a projection/recess which cooperates with a recess/projection on the housing for limiting the rotational path.

Alternatively, the housing can form stops for the turning bolt in order to limit its rotational movement.

As was already mentioned, the thin wall is preferably formed by a plug-in, door or flap in a switch cabinet.

BRIEF DESCRIPTION OF THE DRAWINGS

The invention will be explained more fully in the following with reference to embodiment examples shown in the drawings.

FIG. 8 is a perspective view of the latch according to FIG. 7 mounted in a corner area of a switch cabinet plug-in;

DETAILED DESCRIPTION OF THE INVENTION AND PREFERRED EMBODIMENTS

Figure 1:
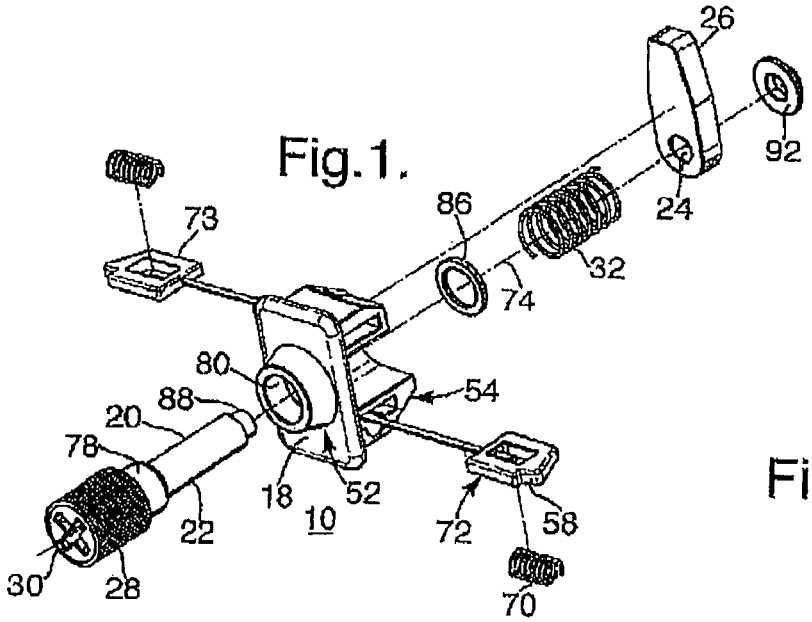
FIG. 1 is an exploded view of a first embodiment form of a pull-turn bolt latch according to the invention.
Figure 2:
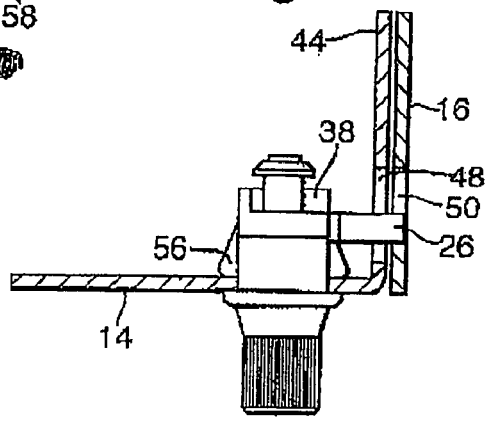
FIG. 2 shows the latch from FIG. 1 installed in a drawer or plug-in which is held in a sheet-metal housing.
Figure 5A:
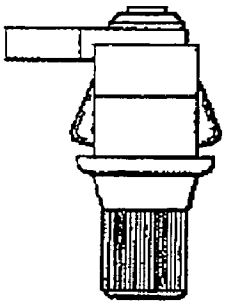
FIGS. 5A to 5G show different views of the latch according to FIG. 2.
Figure 5B:
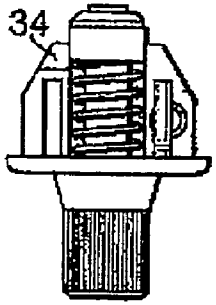
Figure 5C:
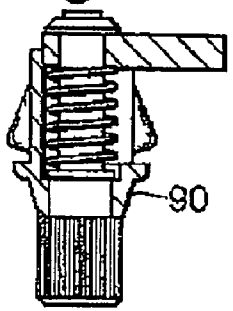
Figure 5D:
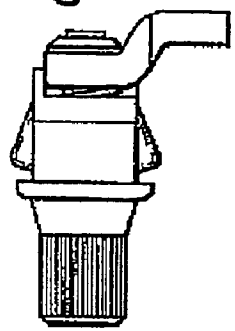
Figure 5E:
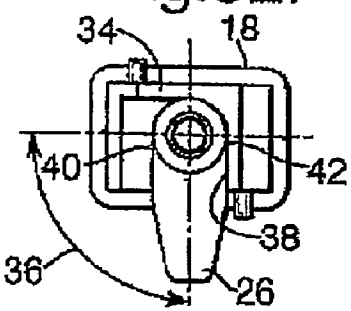
Figure 5F:
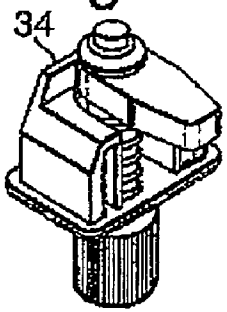
Figure 5G:
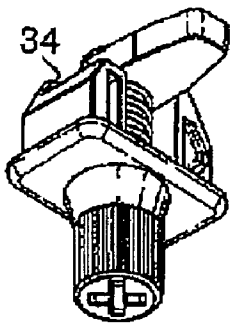
Figure 6:
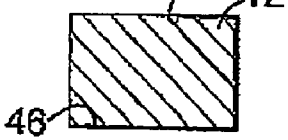
FIG. 6 shows the cutout in the thin wall provided for this latch.

FIG. 1 is an exploded view showing the pull-turn bolt latch 10 for mounting in an opening 12 in a thin wall 14, particularly for securing drawers or plug-ins in switch cabinets 16. The pull-turn bolt latch 10 comprises a housing 18 which can be secured in a non-round opening, for example, as in the present case, in a rectangular opening 12 in a thin wall such as the front surface of a plug-in or drawer 14, and a shaft 20 which is mounted in the housing 18 so as to be rotatable but fixed with respect to axial displacement and which is provided with an external thread 22. A bolt 26 which is provided with a threaded bore hole 24 matching the external thread 22 is guided in the housing 18 when the shaft is rotated by means of a tool or by hand (see the ribbed operating knob 28) and also has, at its front surface, a cross slot 30 accepting a corresponding phillips head tool. When the shaft is rotated, the bolt 24 is guided in such a way that it carries out a rotational movement with the shaft covering at least 90 degrees into the stop position at the outer end of the shaft 20 and carries out a translational movement along the axis of the shaft 20 into the position remote of the stop position while guided in an axial slot, which is formed in the housing for the bolt, during the rotating movement of the shaft. The bolt 26 is loaded by a pressure spring 32 engaging around the shaft 20. This pressing force generates a friction between the external thread 22 of the shaft 20 and the internal thread of the opening 24 of the bolt 26 so that a rotating movement of the shaft, for example, by manual operation 28, leads to a swiveling of the bolt 26 so long as the rotating movement of the bolt is not limited and a rotation of the shaft takes place. The limiting can be carried out by parts of the housing such as, for example, by the projections of the wall 34 which allow the bolt 26 to move along a (rotational) path of approximately 90 degrees as can be seen at reference number 38 in FIG. 5E. The two stop surfaces 34 and 38 which are formed by the housing 18 and are contacted by side surfaces 40, 42 of the bolt 26 in the end position are also shown. As soon as the bolt has reached one of the two stop surfaces, a further rotation of the shaft 20 by means of a turning knob 28 or the like leads to an axial displacement of the bolt 26 on the shaft 20; that is, the bolt 26 accordingly slides, e.g., away from the outermost position on the shaft 20 in direction of the wall plane in the thin wall 14 in which the latch is mounted. When the knob 28 is turned to the right, for example, the bolt or the tongue 26 moves along the stop face 38, according to FIG. 2, and the bolt 26 can be swiveled into a rectangular opening 48 formed by the wall 44, a bend of the front panel surface of the drawer 14 (see FIG. 2). The bolt 26 is then displaced along the axis 74 of the bore hole 24 of the bolt 26 and, finally, strikes the lower end of the slot 50 and, when the latch is further actuated, draws the plug-in 14 upward, referring to FIG. 2, and thus deeper into the switch cabinet and presses the plug-in or drawer 14 inward inside the housing 18 such that it is under tension. The final stretch of the translational movement of the bolt 26 is guided not only by the side wall 38 but also by a prism shape of the housing which is adapted to the outer contour of the bolt 26 and which ensures that no further rotational movement is permitted after this area is reached, but only a movement of perhaps 1 to 2 percent according to the rotational path tolerance. This is shown in FIGS. 5B, 5F and 5G.

Figure 3:
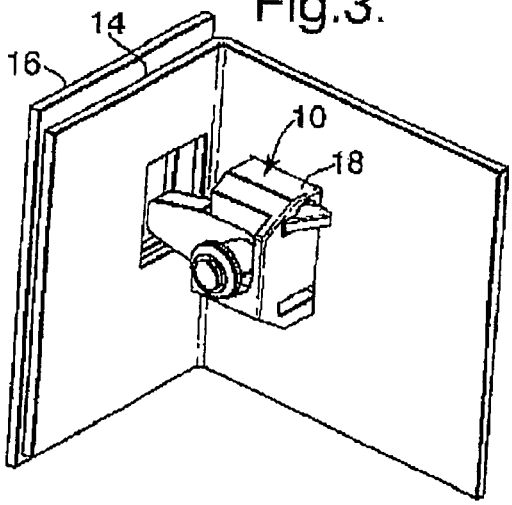
FIG. 3 is a perspective view from the inside of the end area where the latch according to the invention from FIG. 2 is mounted with a drawer.
Figure 4:
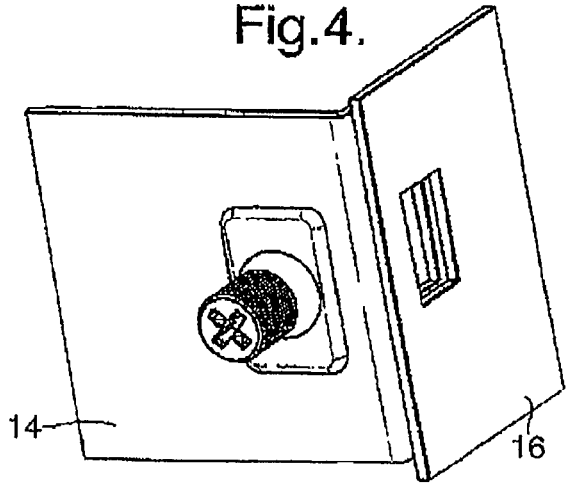
FIG. 4 is a perspective view from the outer side of this corner area with mounted latch according to FIG. 2.

The latch in its mounted position inside a thin wall is shown by way of example in FIGS. 3, 4 and 5.

Further, the housing 10 has, in a mounted position in an opening, a head part or flange 12 which overlaps the outer edge of the opening 12, a body part 54 proceeding from this head part or flange 12 and penetrating the opening 12. Flexible holding elements 56 project from the body part in direction of its outer surfaces and form a contact surface or contact line or contact point 58 for supporting the body part 54 on the rim or edge 58 of the opening 12 without play.

Figure 13:
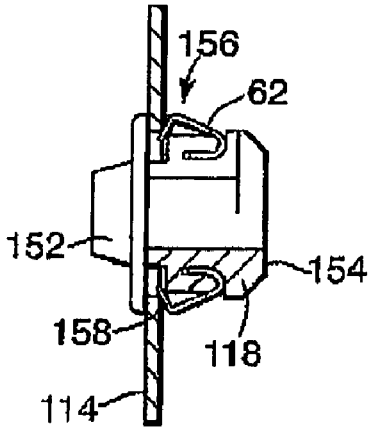
FIG. 13 is a side view of a latch housing which is mounted in an opening in a thin wall and in which the holding elements are formed by leaf spring parts inserted in the body part.
Figure 14A:
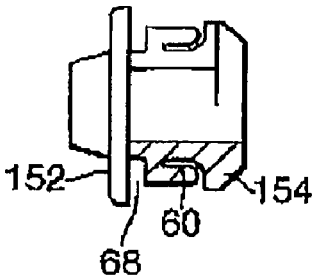
FIGS. 14A to 14D show different views of the housing of the lock device shown in FIG. 13.
Figure 14B:
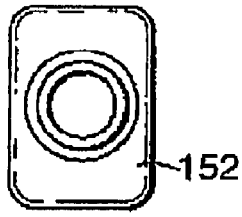
Figure 14C:
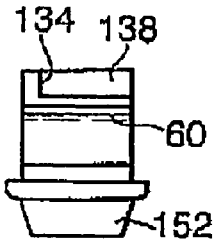
Figure 14D:
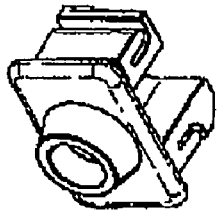
Figure 15A:
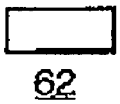
FIGS. 15A to 15C show different views of the associated insertable spring elements.
Figure 15B:
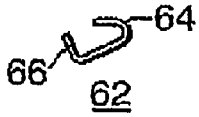
Figure 15C:
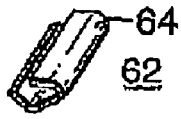

A holding slot 60 is provided in the housing 118 according to FIG. 13 in the associated body part 154 at the narrow ends of the rectangular housing. A leaf spring 62 (see the different views in FIGS. 15A to 15C) can be inserted into the holding slot 60 by its hook part 64 in such a way that the other end, the bend 66, extends into a recess 68 formed behind the flange 152 and interacts with the edge of the associated opening so as to secure the housing in the opening in the manner of a snap-in.

In the embodiment form according to FIG. 1, holding elements are provided instead of leaf springs. The holding elements can be formed by push elements 72 which are supported so as to be displaceable to a limited degree in the body part 54 against the spring force of a spiral spring 70. As can be seen in FIG. 1, a slot in the housing 54 receives the push element 72 and also has a hollow for the spiral spring 70 which, for the rest, is received by a suitable opening in the push element 72. For the rest, the push element 72 forms a holding surface 58 which has an angle with respect to the movement direction such that a self-locking of the push element 72 takes place at its bearing slot when the push element springs back after the housing 18 is pushed into the rectangular opening in a thin wall and the upper side of the push element presses against the narrow side of the channel for the push element in the housing 18.

When the housing is not yet mounted, the spiral spring ensures that the holding element 72 cannot move out of the housing in that a protuberance which holds the spring, and therefore also the push element 72, is provided in the housing.

In order to achieve a slender construction, the body part has a substantially rectangular cross section and at least one holding element proceeds in each instance from two opposite sides of the rectangle as can be seen, e.g., in FIG. 1. The holding elements 270, two of which or four of which are provided (see FIG. 7), are arranged symmetrically with respect to the shaft axis 274. When opposing holding elements 272, 273 are used, they form a group and a group is arranged, respectively, on both sides of the length (see FIG. 7).

Figure 7:
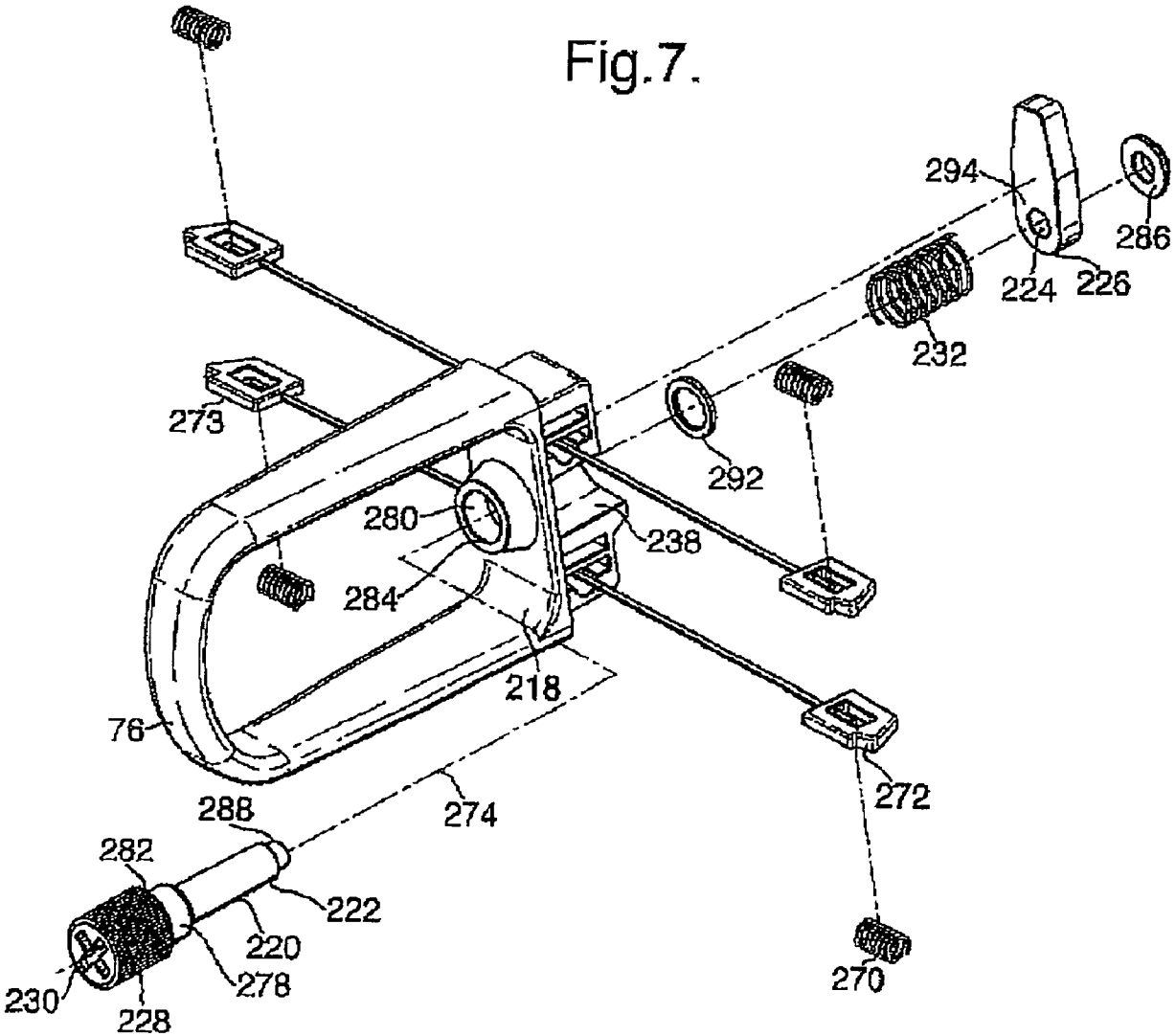
FIG. 7 is an exploded view similar to that in FIG. 1 showing a modified pull-turn bolt latch comprising a handle.

According to FIG. 7, the head part forms a finger grip or handle 76 so that a handle specifically for pulling out the plug-in or drawer is no longer required. Referring to FIG. 7, the drive for the rotation of the shaft 220 is also provided inside the handle, preferably in the form of a turning knob 228 with ribbing and/or with a receptacle 230 for a wrench or insertion tool such as a cross slot 9. The body part also forms at least one projection at its free end which serves as a stop for the rotational movement of the turning bolt.

Figure 8:
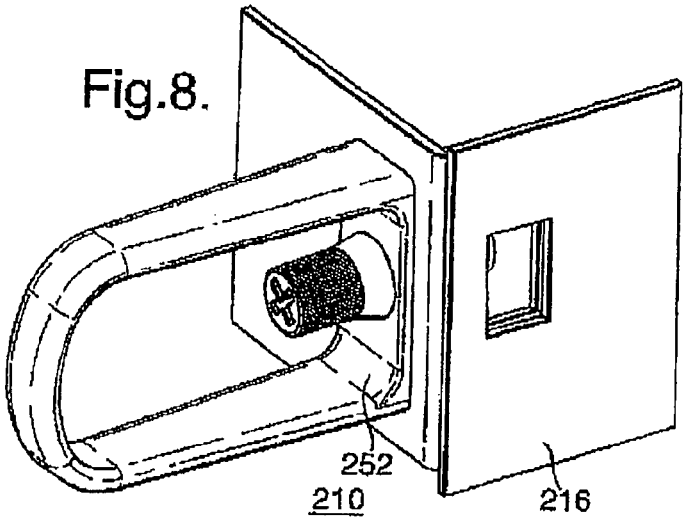
Figure 9:
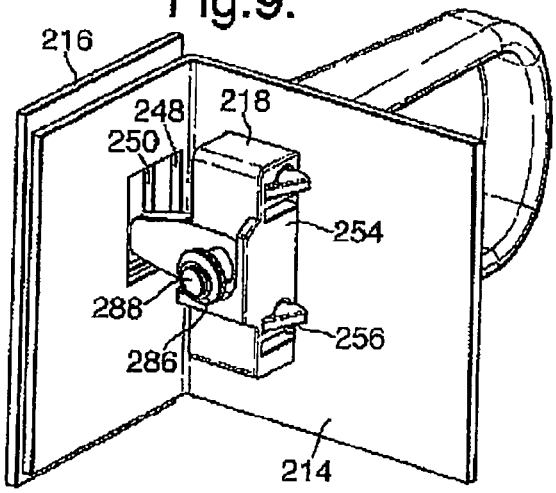
FIG. 9 is a perspective view of the inner corner area of the arrangement according to FIG. 8.
Figure 11:
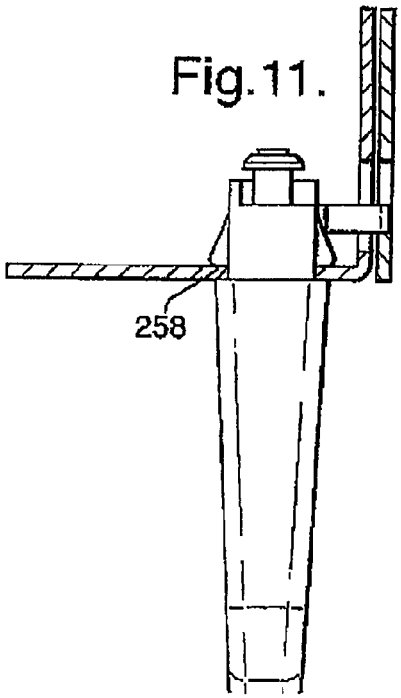
FIG. 11 is a sectional view showing the latch according to FIGS. 7 to 9.
Figure 10:
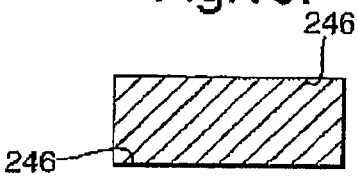
FIG. 10 shows the cutout in the thin wall holding the latch for the latch according to FIGS. 7 to 9.
Figure 12A:
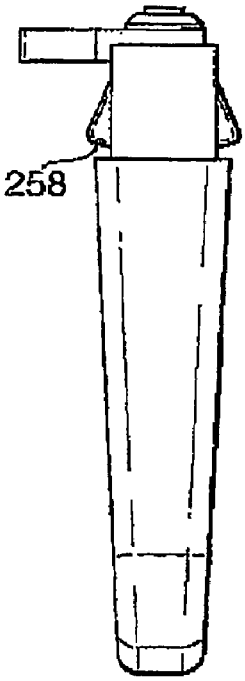
FIGS. 12A to 12D show different views of the mounted latch according to FIG. 11.
Figure 12B:
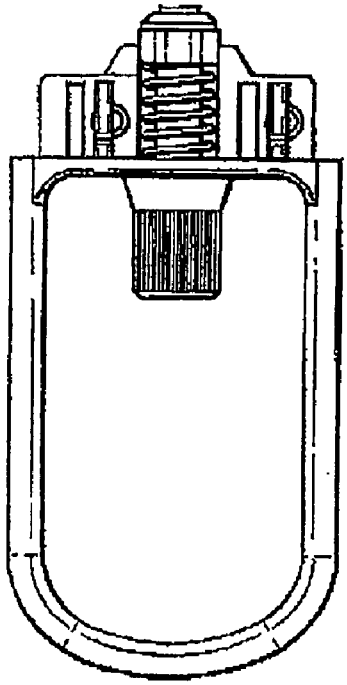
Figure 12C:
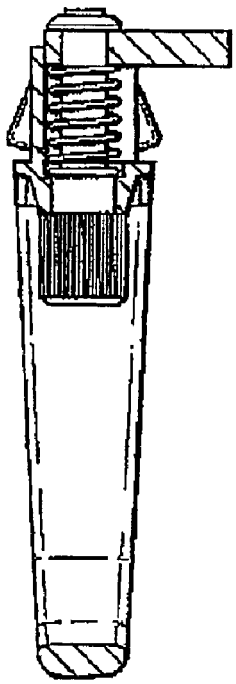
Figure 12D:
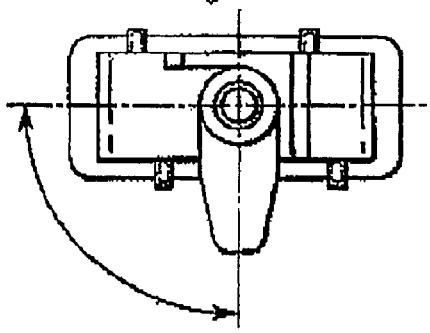
Figure 12E:
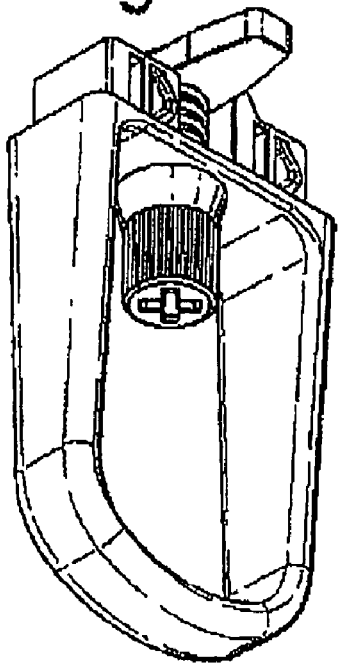
FIGS. 12E and 12F are perspective views of the latch according to FIGS. 7 to 9.
Figure 12F:
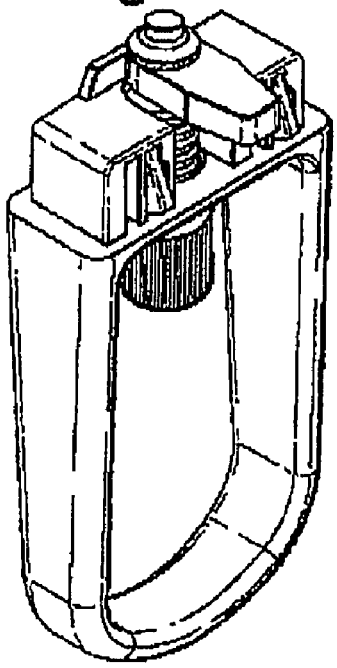

A bearing part 278 is located between the ribbed head 228 and the shaft 220 provided with an external thread. The bearing part 278 may be injection molded from plastic integral with the two parts mentioned above and can be received in a rotatable manner in a bearing bore hole 280. An annular shoulder 282 is located between the bearing circumference 278 and the head 228 and in the mounted state shown in FIG. 8 contacts a shoulder surface 284 of the housing 218 so that the pressure of the spring 232 which acts on a bolt 226 and tends to draw the bolt 226 out can be contained. As was already described, the bolt 226 is displaceable axially on the shaft 220, which is provided with an external thread, by means of an internal thread by the rotation of the shaft 220. The outer position is secured by a retaining washer 286 which can be securely arranged on the end 288 of the shaft 220, which end 288 has a reduced diameter (see also FIG. 9).

The housing 218 forms another inner contact surface or round shoulder 90 (see FIG. 5C) which serves as a contact surface for another disk 292 at which the spring 232 can be supported by one end, while its other end can be supported at the annular surface surrounding the threaded bore hole of the bolt 226.

Figure 16A:
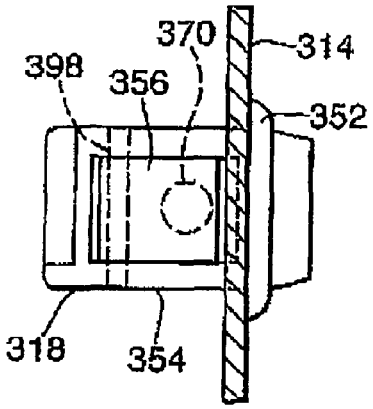
FIGS. 16A and 16B show a side view and an axial sectional view, respectively, of an embodiment form in which the holding elements are levers.
Figure 16B:
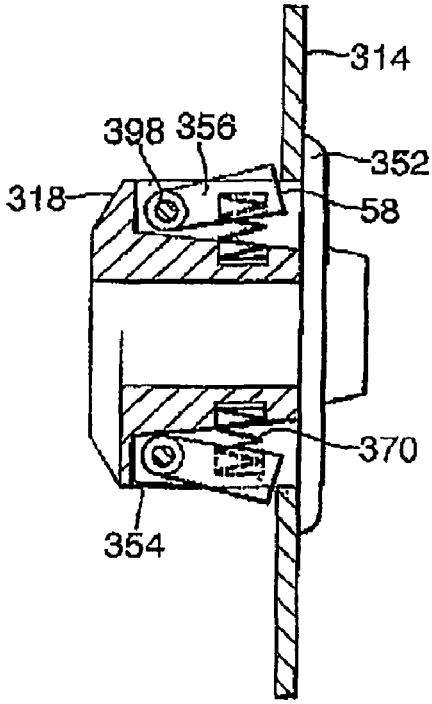

FIG. 16B shows a view in axial section and FIG. 16A shows a side view of an embodiment form in which the holding elements are levers 356 which are supported so as to be swivelable to a limited extent against the force of a spring 356 around an axis 398 extending at a distance from the thin wall 314 and parallel thereto.

Figure 17:
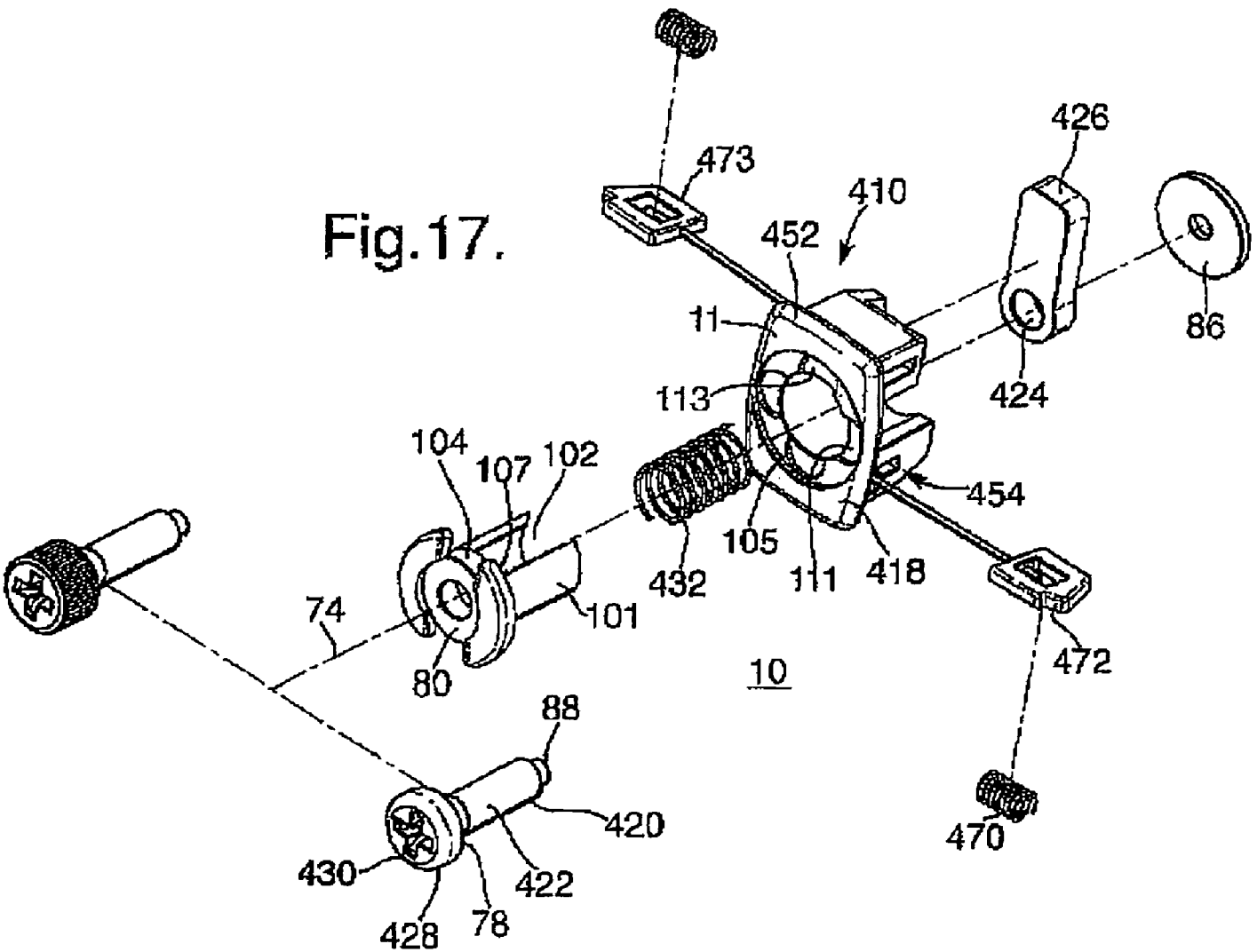
FIG. 17 is an exploded view of another embodiment form of a pull-turn bolt latch according to the invention.
Figure 21A:
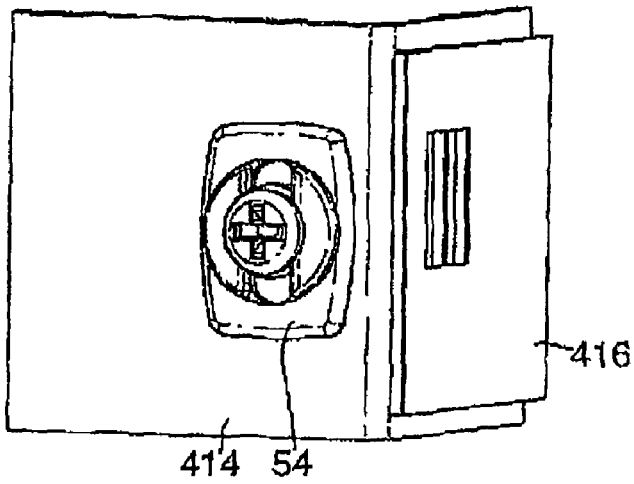
FIGS. 21A, 21B and 21C each shows a perspective view from the outer side of this corner area with mounted latch according to FIG. 17, showing the closing sequence.
Figure 21B:
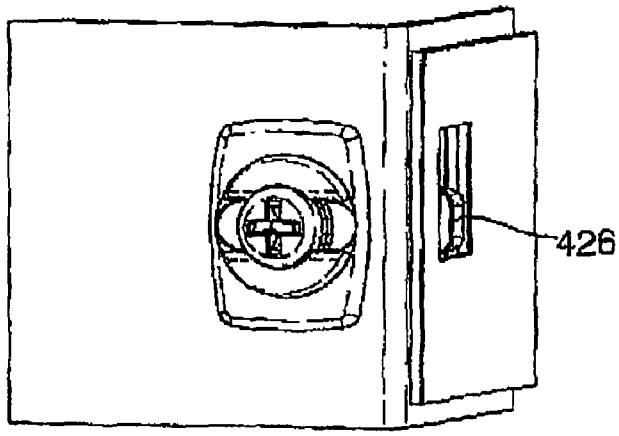
Figure 21C:
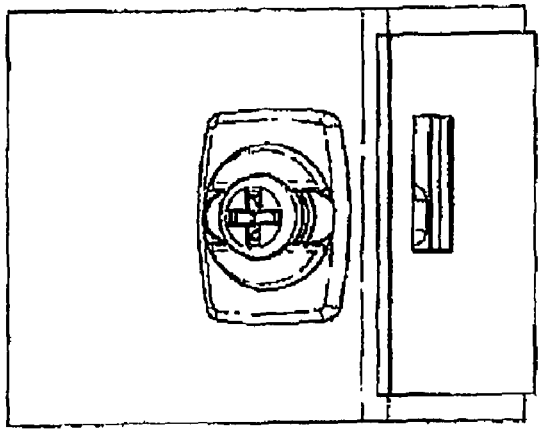
Figure 22A:
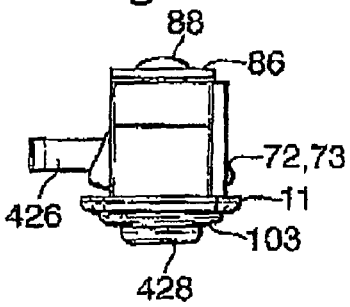
FIGS. 22A to 22D are various side views of the latch according to FIG. 17.
Figure 22B:
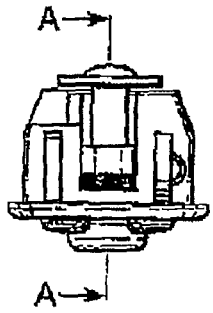
Figure 22C:
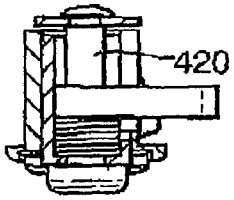
Figure 22D:
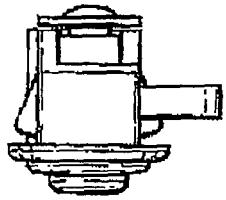

FIG. 17 shows an exploded view of a pull-turn bolt latch 410 for mounting in an opening 12 in a thin wall 414, particularly for securing drawers or plug-ins in switch cabinets 416. The pull-turn bolt latch 410 comprises a housing 418 which can be secured in a non-round opening, for example, as in the present case, in a rectangular opening 12 in a thin wall such as the front surface of a plug-in or drawer 414, and a shaft 420 which is mounted in the housing 418 so as to be rotatable but fixed with respect to axial displacement and which is provided with an external thread 422. A bolt 426 which is provided with a threaded bore hole 424 matching the external thread 422 is guided in the housing 418 when the shaft is rotated by means of a tool or by hand (see screw head 428) and also has, at its front surface, a cross slot 430 accepting a corresponding phillips head tool. When the shaft is rotated, the bolt 424 is guided in such a way that it carries out a rotational movement with the shaft covering at least 90 degrees into the stop position at the outer end of the shaft 420 and carries out a translational movement along the axis of the shaft 420 into the position remote of the stop position while guided in an axial slot formed in the housing for the bolt during the rotating movement of the shaft. The bolt 426 is loaded by a pressure spring 432 engaging around the shaft 420. This pressing force generates friction between the external thread 422 of the shaft 420 and the internal thread of the opening 424 of the bolt 426 so that a rotating movement of the shaft, for example, by manual actuation 428, leads to a swiveling of the bolt 426 as long as the rotational movement of the bolt is not limited and a rotation of the shaft takes place. The limiting can be carried out by parts of the housing such as, for example, by the projections of the wall 434 which allow the bolt 426 to move along a (rotational) path of approximately 90 degrees as can be seen in FIG. 21B. The two stop surfaces 434 and 438 which are formed by the housing 418 and are contacted by side surfaces 442, 444 of the bolt 426 in the end position are also shown. As soon as the bolt has reached one of the two stop surfaces, a further rotation of the shaft 420 by means of a screw head 28 or the like leads to an axial displacement of the bolt 426 on the shaft 420; that is, the bolt 426 accordingly slides, e.g., away from the outermost position on the shaft 420 in direction of the wall plane in the thin wall 414 in which the latch is mounted. When the knob 428 is turned to the right, for example, the bolt or the tongue 426 moves along the stop face 438, according to FIG. 19B, and the bolt 426 can be swiveled into a rectangular opening 48 formed by the wall 46, a bend of the front panel surface of the drawer 414 (see FIG. 19B). The bolt 426 is then displaced along the axis 74 of the bore hole 424 of the bolt 426 and, finally, strikes the lower end of the slot 50 and, when the latch is further actuated, draws the plug-in 414 upward, referring to FIG. 19B, and thus deeper into the switch cabinet and presses the plug-in or drawer 414 inward inside the housing 418 such that it is under tension. The final stretch of the translational movement of the bolt 426 is guided not only by the side wall 438 but also by a prism shape of the housing which is adapted to the outer contour of the bolt 426 and which ensures that no further rotational movement is permitted after this area is reached, but only a movement of perhaps 1 to 2 percent according to the rotational path tolerance. This is shown in FIGS. 21A to 21C.

Figure 18A:
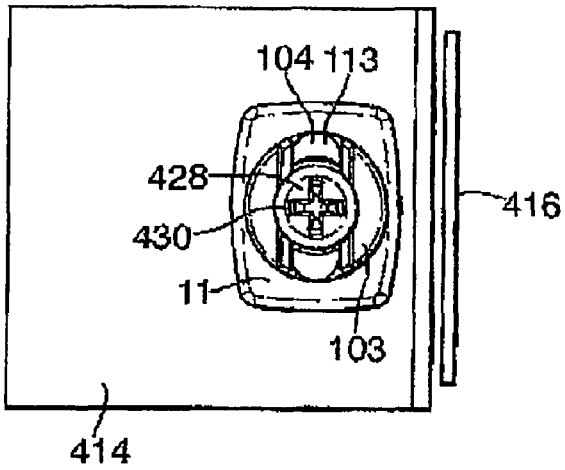
FIGS. 18A and 18B show two views of the latch from FIG. 17 in the open position and installed in a drawer or plug-in which is held in a sheet-metal housing.
Figure 18B:
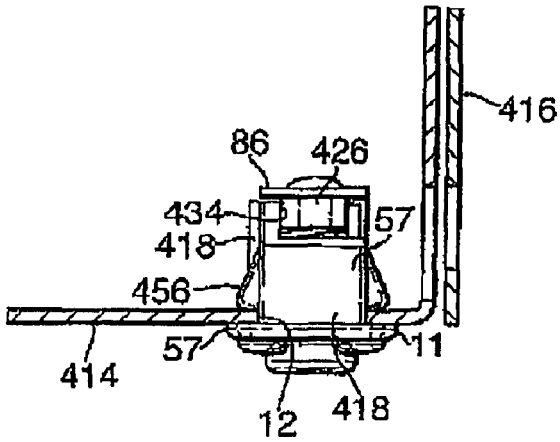
Figure 19A:
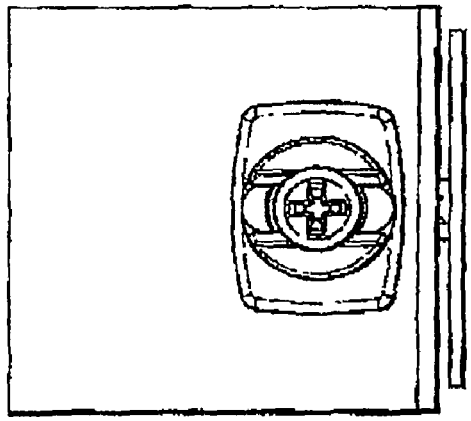
FIGS. 19A and 19B show two views of the latch from FIG. 17 in the closed position and installed in a drawer or plug-in which is held in a sheet-metal housing.
Figure 19B:
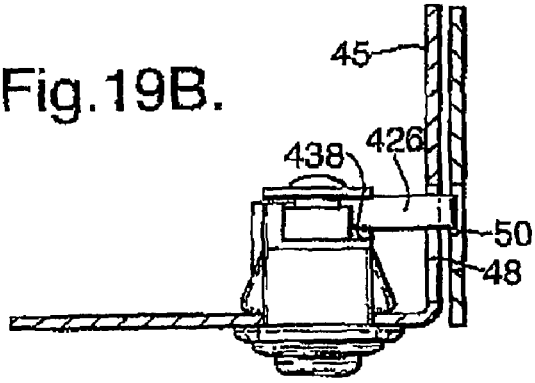
Figure 20:
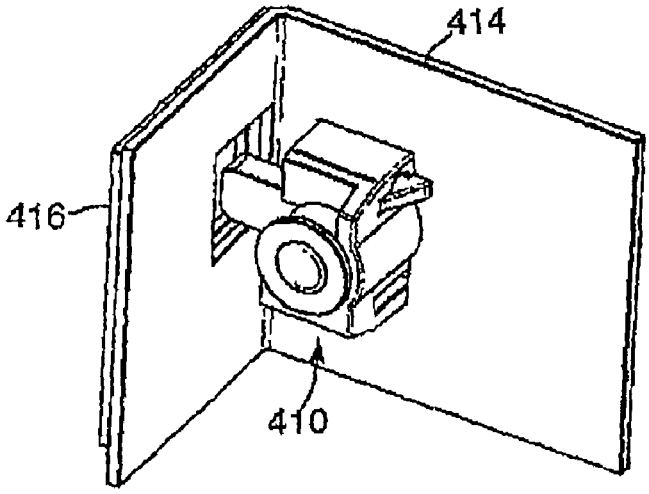
FIG. 20 is a perspective view from the inside of the end area where the latch according to the invention from FIG. 17 is mounted in a drawer.

The latch in its mounted position inside a thin wall is shown by way of example in FIGS. 18B and 19B.

Further, the housing 410 has, in a mounted position in an opening, a head part or flange 11 which overlaps the outer edge of the opening 412, a body part 454 proceeding from this head part or flange 11 and projecting through the opening 412. Flexible holding elements 456, 472, 473 project from the body part in direction of its outer surfaces and form a contact surface or contact line or contact point 458 for supporting the body part 454 on the rim or edge of the opening 12 without play.

In the embodiment form according to FIG. 17, holding elements are provided. The holding elements can be formed by push elements 472 which are supported so as to be displaceable to a limited degree in the body part 454 against the spring force of a spiral spring 470. As can be seen in FIG. 17, a slot in the housing 454 receives the push element 472 and also has a hollow for the spiral spring 470 which, for the rest, is received by a suitable opening in the push element 472. For the rest, the push element 472 forms a holding surface 57 which has an angle with respect to the movement direction such that a self-locking of the push element 472 takes place at its bearing slot when the push element springs back after the housing 418 is pushed into the rectangular opening in a thin wall and the upper side of the push element presses against the narrow side of the channel for the push element in the housing 418.

When the housing is not yet mounted, the spiral spring ensures that the holding element 472 cannot move out of the housing in that a protuberance which holds the spring and therefore also the push element 472 is provided in the housing.

In order to achieve a slender construction, the body part has a substantially rectangular cross section and at least one holding element proceeds in each instance from two opposite sides of the rectangle as can be seen, e.g., in FIG. 17. The holding elements 472, two of which (or four of which) are provided, are arranged symmetrically with respect to the shaft axis 74. When opposing holding elements 472, 773 are used, they form a group and a group is arranged in each instance on both sides of the length, not shown.

The head part can form a finger grip or handle, not shown, so that a handle specifically for pulling out the plug-in or drawer is no longer required.

A bearing part 78 is located between the head 428 and the shaft 420 provided with an external thread. The bearing part 78 may be injection molded from plastic integral with the two parts mentioned above and can be received in a rotatable manner in a bearing bore hole 80 of a sleeve 101 so that the pressure of the spring 432 which acts on the bolt 426 and tends to draw the bolt 426 outward can be contained. As was already described, the bolt 426 is displaceable axially on the shaft 420, which is provided with an external thread, by means of an internal thread by the rotation of the shaft 420. The outer position is secured by a retaining washer 86 which can be securely arranged on the end 88 of the shaft 420, which end 88 has a reduced diameter, and can be clinched by flattening the end 88 (see also FIG. 18B).

The sleeve 101 which is supported by its flange 103 on the rim 105 of the housing 418 forms another inner contact surface or round shoulder 107 at which the spring 432 can be supported by one end, while its other end can be supported at the annular surface surrounding the threaded bore hole of the bolt 426.

The sleeve 101 is outfitted with an axial slot 102 and, at its end, with a flange 103 and encloses the spring 432. The flange 103 has a mark 104 such as a notch or hole and, for the rest, is held so as to be rotatable on the rim 105 of the head part of the housing 418. The flange 103 of the sleeve 101 supports the spring 432 and the outer end 28 of the shaft 20 against the spring force 432 by a rim area 107 facing the spring 432. The slot 102 of the sleeve 101 is penetrated by the bolt 426 so that its rotational movement is transmitted to the sleeve 101 and therefore to its flange 103 with the mark 104 indicating this rotational movement.

When the mark 104 at the flange 103 of the sleeve 101 is aligned with its slot 102, as is shown in FIG. 17, the user immediately knows the direction in which the bolt faces. FIGS. 18A and 18B show the bolt in the open position and FIGS. 19A and 19B show the bolt in the closed position.

The housing 418 can also have a mark which could indicate, in conjunction with the mark 104 at the flange 103 of the sleeve 101, determined rotational positions of the bolt, particularly its end positions (bolt in the open and closed positions) which is offset, e.g., by 90 degrees.

When the mark on the flange 103 of the sleeve 101 is a notch 104 or a hole and the mark on the housing 418 is a colored dot that is arranged in such a way that the notch 104 or hole allows, e.g., a red colored dot 113 arranged on the housing 18 to be seen in one position (e.g., the open position) of the bolt 426 (FIGS. 18A, 18B) and, e.g., a green colored dot 111 to be seen in the second position (e.g., the closed position that is offset by 90 degrees, FIGS. 19A, 19B), the locked state is indicated by the green color and the unlocked state is indicated by the red warning color.

The flange 103 of the sleeve 101 can form a projection/recess which cooperates with a recess/projection on the housing 18 for limiting the rotational path, not shown.

If the snap-in fastening is not desired, the housing could also be screwed (e.g., by a coupling nut) to the thin wall or glued to it by adhesive cement, not shown.

FIGS. 22A, 22B, 22C and 22D show the latch according to the invention from all four sides and, in particular, show the washer 86 clinched to the shaft end 88.

Figure 23A:
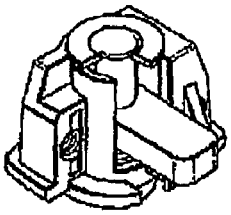
FIGS. 23A to 23C show three perspective views of the latch according to FIG. 17.
Figure 23B:
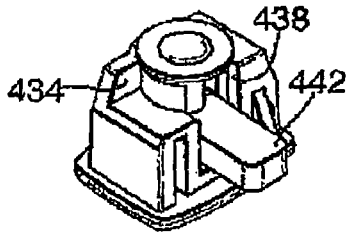
Figure 23C:
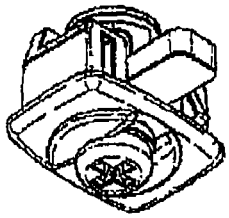

FIGS. 23A, 23B, 23C show perspective views of the latch. FIG. 23A is a partial sectional view.

The threaded pin 420, spring 432, tongue 426, washer 86 and sleeve 101 from a spring-tensioned unit. The sleeve 101 with the external indicator 104 is carried along by the tongue 426 on the 90-degree path and accordingly shows the bolt position.

Instead of the head-shaped shaft 420, a knurled knob or small handle could also be used, for example.

The invention is commercially applicable in switch cabinet construction.

While the foregoing description and drawings represent the present invention, it will be obvious to those skilled in the art that various changes may be made therein without departing from the true spirit and scope of the present invention.

REFERENCE NUMBERS

10, 410 pull-turn bolt latch
11 flange
12, 112 opening
14, 114, 214, 314, 414 thin wall, plug-in, door, flap
16, 216, 416 switch cabinet
18, 118, 218, 318, 418 housing
20, 220, 420 shaft
22, 222, 422 external thread
24, 224, 424 threaded bore hole
26, 226, 426 bolt
28, 228, 428 screw head, drive
30, 230, 430 cross-slot, drive
32, 232, 432 spring
34, 134, 434 stop, projection/recess
36 stop, projection/recess
38, 138, 238, 438 stop
40 side surface
42 side surface of the bolt
44 side surface of the bolt
45 wall
46, 146 edge of the opening
48, 248 opening, edge of an opening
50, 240 slot, edge of an opening
52, 152, 252, 352, 452 head part, flange
54, 154, 254, 354 body part
56, 156, 256, 356, 456 holding element
57 holding surface
58 contact surface, contact line, contact point
62 leaf spring part
64 leaf spring part
66 leaf spring part
370, 470 spring force
72, 272, 472 push element
73, 273, 473 push element
74, 274 shaft axis
76 finger grip
78 bearing part
80 bearing bore hole
86 retaining washer
88 end
101 sleeve
102 slot of the sleeve
103 flange of the sleeve
104 mark, notch, hole, indicator
105 rim
107 round shoulder, rim area
111 mark, green colored dot
113 mark, red colored dot

The invention claimed is:

1. A pull-turn bolt latch configured to be mountable in an opening in a thin wall, the pull-turn bolt latch comprising:

a housing that can be secured in a non-round opening in a thin wall;

a shaft which is mounted in the housing so as to be rotatable about a shaft axis, but fixed with respect to axial displacement relative to the housing, the shaft being provided with an external thread; and a bolt on said shaft, where the bolt is acted upon by pressure by a spring engaging around the shaft, and the bolt has a threaded bore hole which matches with the external thread of the shaft;

wherein the housing includes:

a first stop surface;

a second stop surface; and a third stop surface configured to face the second stop surface;

wherein the bolt is guided by the housing and the external thread of the shaft so as to have a first movement and a second movement, where:

the first movement is a rotational movement covering at least 90° with the shaft where the bolt moves between a first stop position, at which the bolt directly contacts the first stop surface of the housing, and a rotational stop position, at which the bolt directly contacts the second stop surface of the housing, when the shaft is rotated by hand or by a tool; and the second movement is a translational movement in an axial direction when the bolt is in the rotational stop position, whereby the movement of the bolt in the axial direction is guided by the second and third stop surfaces when the shaft is rotated by hand or by a tool such that the bolt is located between the second and third stop surfaces during the translational movement;

wherein said housing has:

a head part which covers the outer edge of the opening in the mounted position; and a body part proceeding from said head part and penetrating the opening;

wherein flexible holding elements project from the body part in direction of the outer surface thereof and are self-adjustable so as to support the body part without play on the rim or edge of the opening, each holding element being separate from the body part and any other holding element.

2. The latch according to claim 1;

wherein the body part has a substantially prism-shaped cross section, and one holding element proceeds from one side of the body part and another holding element proceed from an opposite side of the body part.

3. The latch according to claim 2;

wherein said cross section of the body part is rectangular.

4. The latch according to claim 2;

wherein a plurality of holding elements are arranged symmetrically with respect to the shaft axis.

5. The latch according to claim 2;

wherein two opposing holding elements form a group in each instance; and wherein the group is arranged, respectively, on both sides of the shaft.

6. The latch according to claim 1;

wherein the head part forms a handle or finger grip.

7. The latch according to claim 1;

wherein a drive for rotating the shaft is mounted in the head part.

8. The latch according to claim 1;

wherein the free end of the body part forms at least one projection which serves as a stop for the rotational movement of the turning bolt.

9. The latch according to claim 1;

wherein one stop for the rotational movement of the turning bolt is formed by the body part and the other stop is formed by a suitably arranged edge of an opening in a bend or a shoulder of the thin wall.

10. The pull-turn bolt latch according to claim 1;

wherein an axially slit sleeve, which is provided with a flange at one end, engages around the spring, the flange having a mark and, for the rest, is held on the head part of the housing so as to be rotatable;

wherein the flange of the sleeve supports the spring and the outer end of the shaft against spring force by a rim area facing the spring; and wherein the slot of the sleeve is penetrated by the bolt whose rotational movement is transmitted to the sleeve and therefore to its flange.

11. The pull-turn bolt latch according to claim 10;

wherein the mark at the flange of the sleeve is aligned with its slot.

12. The pull-turn bolt latch according to claim 10;

wherein the housing likewise has a mark which indicates, in conjunction with the mark at the flange of the sleeve, determined rotational positions of the bolt.

13. The pull-turn bolt latch according to claim 10;

wherein the mark on the flange of the sleeve is a notch or a hole; and wherein the mark on the housing is a colored dot that is arranged in such a way that the notch or hole allows the colored dot to be seen in one position of the bolt.

14. The pull-turn bolt latch according to claim 10;

wherein the flange of the sleeve forms a projection/recess which cooperates with a recess/projection on the housing for limiting the rotational path.

15. The pull-turn bolt latch according to claim 1;

wherein the shaft provided with the external thread has, at its outer end, a head in the form of a screw head with a cross slot or the like tool receptacle, or in the form of a knurled knob, or in the form of a small lever.

16. The pull-turn bolt latch according to claim 1;

wherein the body part has a screw fastening instead of flexible holding elements.

17. The pull-turn bolt latch according to claim 1;

wherein the body part has a glue fastening or the like instead of flexible holding elements.

18. The latch according to claim 1;

wherein the thin wall is formed by a plug-in or a drawer, door, or flap in a switch cabinet.

19. The latch according to claim 1;

wherein said holding elements are formed by leaf spring parts which are inserted into the body part.

20. The latch according to claim 1;

wherein said holding elements are formed by push elements which are mounted in the body part so as to be displaceable in a defined manner against spring force.

21. The latch according to claim 1;

wherein said holding elements are formed by levers which are swivelable in a defined manner at the body part against spring force around an axis extending parallel to the thin wall.

22. The latch according to claim 19;

wherein the spring parts are secured by lateral edges of the opening after the housing is mounted in the opening.

23. The latch according to claim 19;

wherein the spring parts are formed by the ends of an individual leaf spring that is bent in a U-shape.

* * * * *